US007174749B2

(12) United States Patent
Ternon et al.

(10) Patent No.: US 7,174,749 B2
(45) **Date of Patent: *Feb. 13, 2007**

(54) EDGECOMB RESISTANT WEFT INSERTION WARP KNIT FABRIC

(75) Inventors: Gerard Ternon, Fauquet-Lemaitre (FR); Ramesh Keshavaraj, Peachtree City, GA (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/321,470

(22) Filed: Dec. 29, 2005

(65) Prior Publication Data

US 2006/0107701 A1 May 25, 2006

Related U.S. Application Data

(62) Division of application No. 10/993,988, filed on Nov. 19, 2004, now Pat. No. 7,013,681.

(51) Int. Cl.
*D04B 23/12* (2006.01)

(52) U.S. Cl. ..... 66/192

(58) Field of Classification Search ..... 66/190–193, 66/195; 442/305, 313, 314
See application file for complete search history.

(56) References Cited

U.S. PATENT DOCUMENTS

| | | | | | |
|---|---|---|---|---|---|
| 1,711,624 | A * | 5/1929 | Vorck et al. | ..... | 66/84 R |
| 4,183,993 | A * | 1/1980 | Benstead et al. | ..... | 66/190 |
| 4,425,398 | A * | 1/1984 | Berczi | ..... | 66/193 |
| 4,518,640 | A * | 5/1985 | Wilkens | ..... | 66/192 |
| 4,722,203 | A * | 2/1988 | Darjee | ..... | 66/202 |
| 4,787,219 | A * | 11/1988 | Sato et al. | ..... | 66/190 |
| 5,065,599 | A * | 11/1991 | Groshens | ..... | 66/84 A |
| 5,317,886 | A * | 6/1994 | Prahl | ..... | 66/192 |
| 5,916,830 | A | 6/1999 | Graham | ..... | 442/314 |
| 5,945,359 | A | 8/1999 | Graham | ..... | 442/314 |
| 6,389,851 | B1 * | 5/2002 | Groshens | ..... | 66/192 |

* cited by examiner

*Primary Examiner*—Danny Worrell
(74) *Attorney, Agent, or Firm*—Terry T. Moyer; Sara M. Current

(57) ABSTRACT

A fabric construction utilizing a tying yarn knitting arrangement wherein a portion of the tying yarns are threaded to engage needles so as to form two stitches with one on either side of the inlay warp yarn at rows of stitch formation. The neighboring stitches resist yarn separation and resultant combing while also blocking the commencement and propagation of de-knitting when a tying yarn is broken thereby enhancing seam strength character.

2 Claims, 8 Drawing Sheets

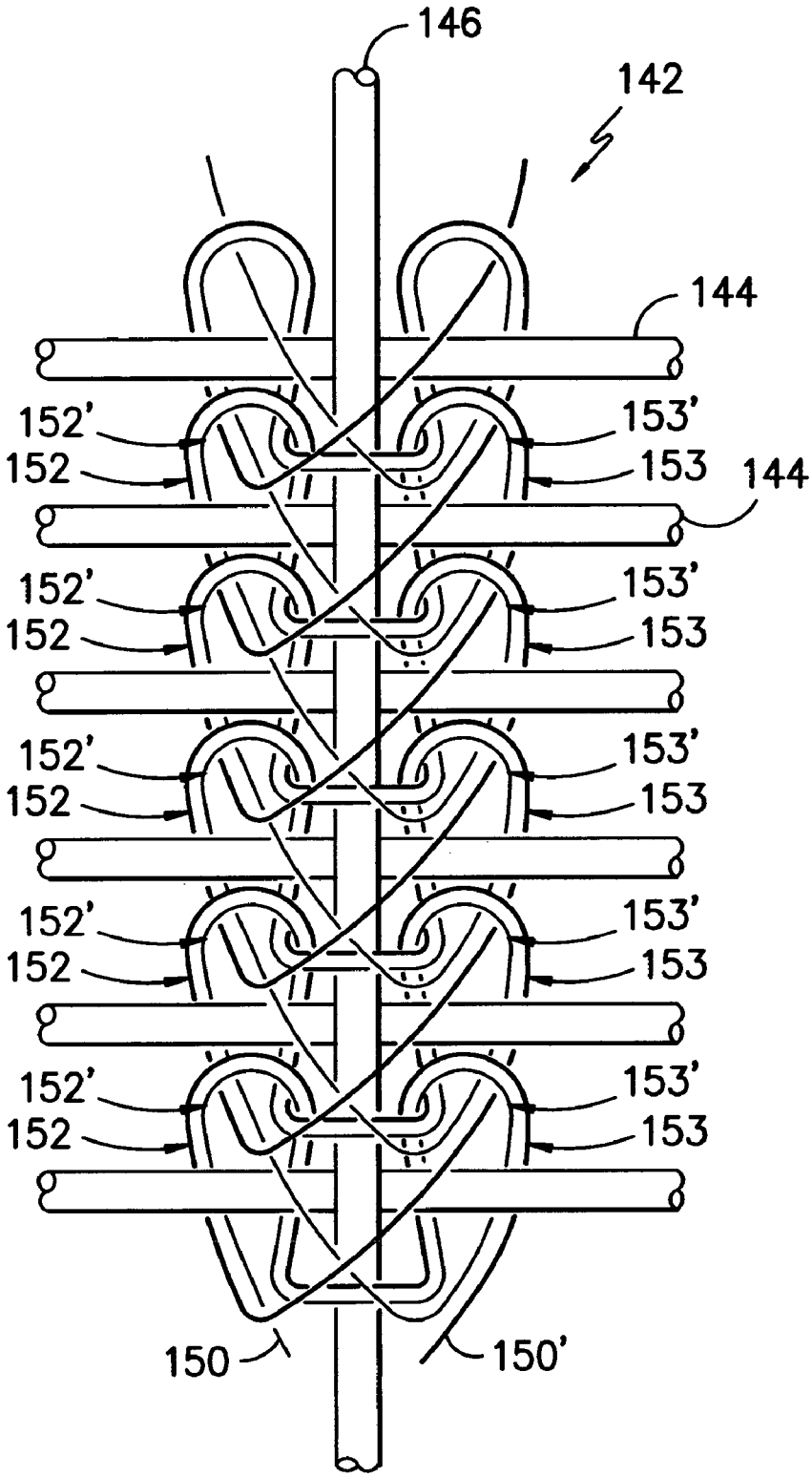
FIG. —5—

EDGECOMB RESISTANT WEFT INSERTION WARP KNIT FABRIC

CROSS-REFERENCE TO RELATED APPLICATIONS

This application is a divisional of U.S. patent application Ser. No. 10/993,988, filed on Nov. 19, 2004 now U.S. Pat. No. 7,013,681. These references are all hereby incorporated herein in their entirety by specific reference thereto.

TECHNICAL FIELD

This invention relates to a weft inserted warp knit fabric for use in applications requiring substantial seam strength such as vehicle air bags, automotive bolsters, automotive upholstery, automotive headliners, automotive door panels, awnings, grass catcher bags and the like. The present invention also relates to substrate constructions of substantial geometric stability adaptable for coating and lamination for use in applications such as billboards, backlit signs, tape and the like. In particular, the present invention relates to a weft inserted warp knit fabric providing a stable construction having strength and stability characteristics comparable to traditional woven fabrics while greatly reducing the quantity of yarn used in producing the fabric.

BACKGROUND OF THE INVENTION

In a number of environments such as automotive environments, awnings, grass catcher bags and the like, the materials of construction are subjected to substantial stress at the formation seams. In other environments such as billboards, backlit signs, tape, and the like a coated or laminated substrate is used that must retain a regular geometry during handling so as to promote uniformity of strength in the finished product. In the past, such articles have normally been formed from high strength woven textiles that derive strength and stability from the tight weaving of substantial quantities of yarn.

Regardless of the fabric construction utilized, in seamed environments the zones adjacent the seams may experience relatively high stress levels during the life of the formed article. Due to these stress levels the zones immediately adjacent the seams may be subject to so called "combing" wherein the yarns adjacent the seam spread apart form one another under pressure and thereby open up interstitial voids or pinholes between the formation yarns. In undesirable situations such combing may also be accompanied by localized yarn breakage due to stress and/or damage from sewing needles. In order to reduce adverse consequences of seam combing and yarn breakage it has been common practice to utilize tightly woven constructions wherein the yarns forming the fabric are packed together in interwoven relation at a relatively high density. Such constructions reduce combing and also tend to arrest any propagation of a tear if one develops in the fabric.

In the past, knit structures have generally been considered to have limited utility in environments of high seam stress due to the fact that such constructions may be more prone to combing due to reduced structural stability. Moreover, localized yarn breakage may lead to an unraveling of the fabric thereby leading to extended tears. In traditional weft inserted warp knit fabrics a layer of in-lay warp yarns is disposed across a layer of inserted weft yarns such that the warp yarns are disposed in a first plane and the weft yarns are in a second different plane. The warp yarns and the weft yarns are bound together by a smaller tying yarn or stitching yarn that is knit so as to form an arrangement of stitches with one stitch at each row. In these prior constructions if the tying yarn is broken such as when the fabric is cut or sewn, the tying yarn can begin to de-knit and the inlay warp yarns can pull away from the weft yarns. While the effect of such de-knitting may be at least partially addressed by using two or more layers of fabric laminated together, such lamination may give rise to an undue level of complexity. Moreover, the total thickness and fiber requirements for a multi-layer construction with two adjoined layers of weft inserted warp kit fabric may offer little improvement over traditional single layer woven constructions.

SUMMARY OF THE INVENTION

The present invention provides advantages and alternatives over the prior art by providing a fabric of weft inserted warp knit construction that will perform in a high stress seam environment without the propensity for increased combing and de-knitting associated with prior weft inserted warp knit constructions.

According to one aspect of the invention, a fabric of weft inserted warp knit construction is provided utilizing a tying yarn knitting arrangement wherein each tying yarn is threaded so as to form two stitches (one on either side of the inlay warp yarn) at each row of stitch formation. The neighboring stitches resist yarn separation and resultant combing while also blocking the commencement and propagation of de-knitting when a tying yarn is broken such as by sewing, cutting or the like.

According to another aspect of the invention, a fabric of weft inserted warp knit construction is provided utilizing a tying yarn knitting arrangement wherein two or more tying yarns are threaded such that each tying yarn forms two stitches (one on either side of the inlay warp yarn) at each row of stitch formation. The neighboring stitches resist yarn separation and resultant combing while also blocking the commencement of de-knitting when a tying yarn is broken. Moreover, even if one tying yarn undergoes breakage and de-knitting, an independent yarn with stitches on either side of the inlay warp yarn remains in place.

According to another aspect of the invention a fabric of weft inserted warp knit construction is provided incorporating a layer of fibrous material or film through which tying yarns extend in a stitch forming pattern.

According to yet another aspect of the invention a fabric of weft inserted warp knit construction is provided that is suitable for lamination to additional layers.

According to yet another aspect of the invention a fabric of weft inserted warp knit construction is provided that is suitable for acceptance of a topical transfer coating across one or both sides.

According to still another aspect of the invention a fabric of weft inserted warp knit construction is provided that is suitable for acceptance of an extrusion coating across one or both sides.

According to other aspects of the invention methods of making a fabric of weft inserted warp knit construction providing seam stability and articles incorporating such fabric are also provided.

BRIEF DESCRIPTION OF THE DRAWINGS

The accompanying drawings which are incorporated in and which constitute a part of this specification illustrate an exemplary embodiment of the present invention and together with the detailed description set forth below serve to explain the principles of the invention wherein:

FIG. 5 is a view illustrating a three bar weft inserted warp knit construction for a fabric with two tying yarns each forming pairs of stitches on either side of an inlay warp yarn at every row of stitch formation;

DESCRIPTION OF PREFERRED EMBODIMENTS

Figure 1:
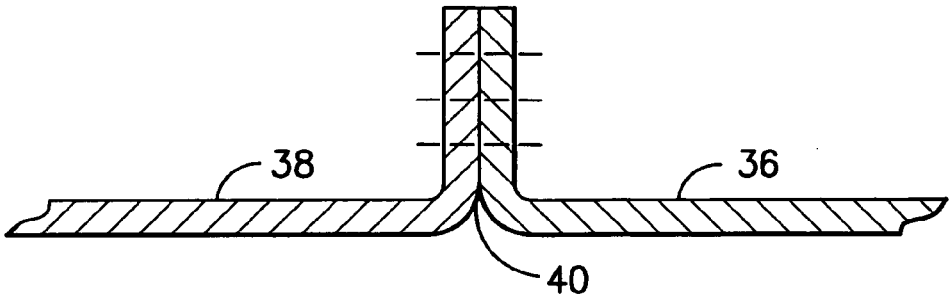
FIG. 1 illustrates an exemplary seam construction.

Turning now to the drawings, wherein like elements are denoted by like reference numerals in the various views, a representative seam construction is illustrated in FIG. 1. As shown, in a seamed construction a first panel 36 formed from a blank of suitable construction material such as a fabric or the like is joined to a second panel 38 formed from a blank of suitable construction material such as a fabric or the like along a seam line 40 by suitable stitching threads. In some environments where seam strength is particularly critical after the seam line 40 is formed, the joined segments shown as projecting upwardly in FIG. 1 may thereafter be folded over and attached to the surface of one of the panels 38, 40 by stitching so as to develop a so called "foldover" or "top stitch" seam. As will be appreciated, regardless of the seam structure, when a force is applied pulling the panels away from one another, the panels are placed into tension with high levels of stress immediately adjacent the seam line 40.

In environments where the control of air permeability is important it is contemplated that adhesives may be used between the panels along the seam line 40 with stitching threads extending across the adhesive. The combination of adhesive with sewn seams may reduce the potential for gas leakage around the perforating sewing threads. By way of example only, and not limitation, for rigorous environments suitable adhesives may include an adhesive marketed by Toray and Dow Chemical Company under the trade designation SE6714; an adhesive marketed by Shinetsu under the trade designation X-323-83; an adhesive marketed by Dow Chemical Company under the trade designation DOW-832; an adhesive marketed by Rhodia under the trade designation SILBIONE; an adhesive marketed by Wacker under the trade designation ELASTOSIL; and an adhesive marketed by General Electric under the trade designation WMO-0106-570.

Even when seams are formed incorporating appropriate adhesives, in the event that the panels 36, 38 are textile fabrics formed from an arrangement of crossing yarns, the yarns of the fabrics tend to spread apart under tension thereby causing spaces between the yarns to open up and creating the phenomenon known as combing in which pin holes open up. In extreme cases one or more yarns may break. As will be appreciated, combing and yarn breakage are generally undesirable.

Figure 2:
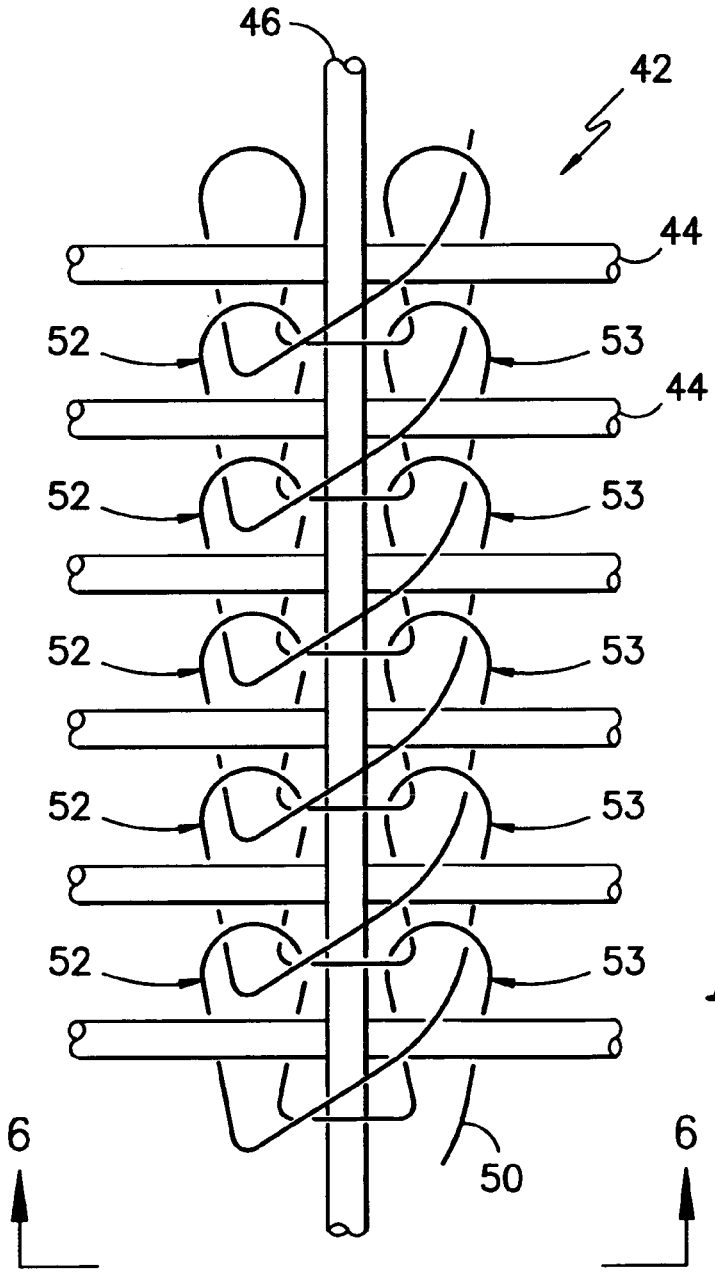
FIG. 2 is a view illustrating a two bar weft inserted warp knit construction for a fabric with a tying yarn forming pairs of stitches on either side of an inlay warp yarn at every row of stitch formation.
Figure 3:
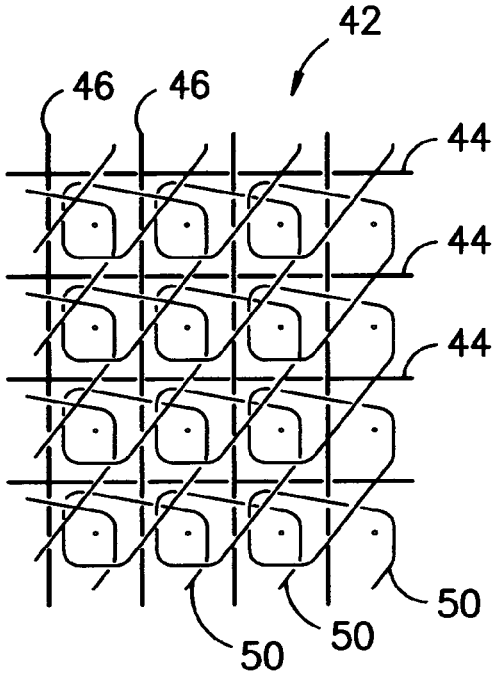
FIG. 3 is a needle point diagram showing the yarn stitch arrangement for the fabric construction illustrated in FIG. 2 wherein each tying yarn engages a pair of needles on either side of inlay warp yarns to form stitches on either side of the inlay warp yarns.

The present invention utilizes blanks of a weft inserted warp knit fabric as the material for forming panels joined along high stress seams. A first exemplary construction of a weft inserted warp knit substrate fabric 42 for use in high stress seam environments is shown in FIGS. 2 and 3. As shown, in this construction the fabric 42 includes an arrangement of substantially parallel weft yarns 44 in a first plane with a plurality of in-lay warp yarns 46 disposed in a second different plane. A tying yarn 50 (also referred to as a stitching yarn) is knitted with a stitch pattern extending in the machine direction such that each tying yarn forms a double column of stitches with two stitches 52, 53 made at each row of the stitch formation. The stitches 52 in the first column are on one side of a warp yarn 46 and the stitches 53 in the second column are on the opposite side. Such a weft inserted warp knit fabric construction may be formed using commercially available equipment. By way of example only, and not limitation, one manufacturer of such equipment is Karl Mayer—Malimo Gmbh, located in Chemnitz Germany. Another manufacturer is Liba Gmbh located in Naila Germany.

As will be understood, a stitch is formed when a yarn loop is pulled through a preceding yarn loop. In the present construction where the tying yarn forms two stitches at each row of stitch formation, the yarn is less prone to de-knitting than a construction wherein each tying yarn forms only a single stitch. As illustrated, the two stitches 52, 53 formed by each yarn at each row of stitch formation are preferably disposed on opposite sides of a warp yarn 46 with one weft yarn inserted at every row of stitch formation. However, it is also contemplated that the weft yarns 44 may be inserted more sparingly such that there are multiple rows of stitches for each weft yarn 44. Likewise, it is also contemplated that there may be multiple wefts for each row of stitches.

In practice it is contemplated that the actual yarn selection may be subject to a wide range of alternatives. By way of example only, it is contemplated that the weft yarns 44 and in-lay warp yarns 46 may be characterized by a linear density in the range of about 1.9 denier (2 dtex) to about 1500 denier (1670 dtex). Such yarns may be monofilament or multifilament with flat, textured or spun construction. The tying yarn 50 is preferably characterized by a linear density in the range of about 5.5 denier (6 dtex) to about 250 denier (280 dtex). Each of the yarns may be formed of suitable fiber materials such as polyester, nylon, polyurethane, aramid, polyethylene, NOMEX® or the like. It is also contemplated that combinations of any such yarns or materials may be utilized if desired.

Referring to FIGS. 2 and 3, in the illustrated pattern the tying yarn 50 is arranged to engage two needles at each row with a closed stitch notation of (0.2/0.2). In the illustrated construction the in-lay warp yarn 46 is disposed between the same two needles thereby assuming a stitch notation of (0.0/0.0). Thus, the fabric is a two bar fabric in which one bar carries the in-lay warp yarn 46 and the other bar carries the tying yarn 50.

Figure 4:
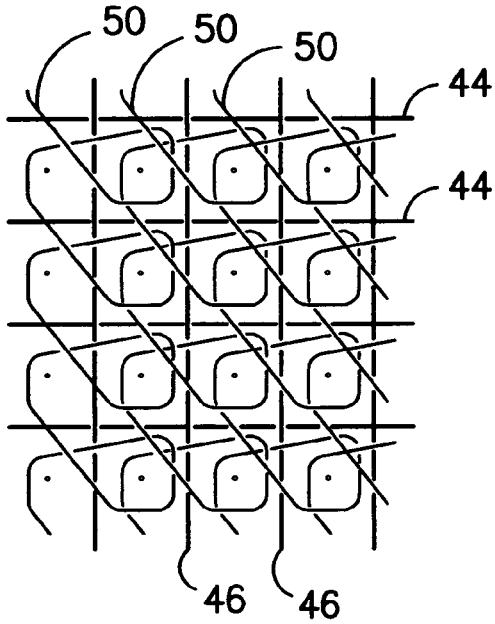
FIG. 4 is a needle point diagram showing another yarn stitch arrangement wherein each tying yarn engages a pair of needles on either side of inlay warp yarns to form stitches on either side of the inlay warp yarns.

Of course, it is contemplated that the actual stitching arrangement is adaptable to numerous variations that nonetheless cause the tying yarn 50 to form two stitches at each stitch formation row. By way of example only, it is contemplated that the tying yarns 50 may be threaded to move in the opposite direction around the needles so as to utilize a closed stitch notation of (2.0/2.0) as shown in FIG. 4. Still other contemplated closed stitch notations for the tying yarns 50 are (2.0/1.3) or (2.0/2.4). The tying yarn 50 may also be knitted in an open stitch arrangement if desired. Exemplary stitch notations for such open stitch arrangements include (0.2/2.0), (2.0/0.2), (0.2/3.1) and (0.2/4.2). It is also contemplated that the inlay warp yarns 46 may be moved in a pattern between adjacent needles in a zigzag orientation such as by using a stitch notation of (0.0/1.1) or (1.1/0.0).

In the arrangements illustrated in FIGS. 2–4, the bars are fully threaded. However, it is also contemplated that one or both bars can be only partially threaded such that yarns are taken out of the construction and a more open fabric is produced. Such partially threaded constructions may offer the benefit of further reducing yarn requirements. It is also contemplated that all or a portion of the warp yarns 46 and/or all or a portion of the weft yarns 44 may be eliminated if desired such that the tying yarn 50 is in the form of a more open knit structure.

Figure 5A:
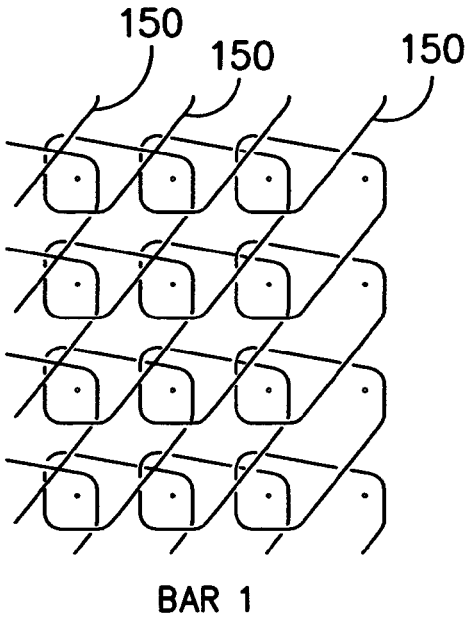
FIG. 5A is a needle point diagram illustrating the yarn movement of the bar 1 tying yarn in formation of the fabric illustrated in FIG. 5.
Figure 5B:
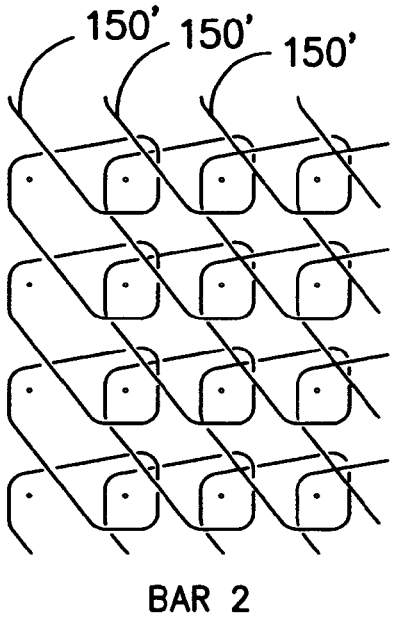
FIG. 5B is a needle point diagram illustrating the yarn movement of the bar 2 tying yarn in formation of the fabric illustrated in FIG. 5.
Figure 5C:
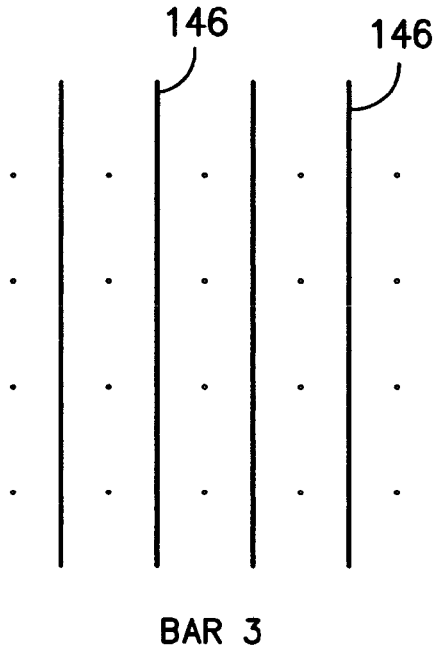
FIG. 5C is a needle point diagram illustrating the bar 3 warp yarn in the fabric illustrated in FIG. 5.

In FIG. 5 there is illustrated another embodiment of a weft inserted warp knit substrate fabric 142 wherein elements corresponding to those previously described are designated by like reference numerals increased by 100. As will be appreciated, the construction illustrated in FIG. 5 is a three bar construction in which bar 1 carries tying yarn 150 with a movement around two needles at each row with a closed stitch notation of (0.2/0.2) thereby yielding a pair of stitches 152, 153 on either side of the in-lay warp yarn 146. The bar 1 movement is illustrated in FIG. 5A. In the construction illustrated in FIG. 5, a second tying yarn 150' is carried by bar 2 with a movement around two needles at each row in a pattern opposite to the bar 1 tying yarn so as to form a closed stitch notation of (2.0/2.0) thereby yielding a pair of stitches 152', 153' on either side of the in-lay warp yarn 146. The bar 2 movement is illustrated in FIG. 5B. Bar 3 carries the in-lay warp yarn 146. The bar 3 yarn is illustrated in FIG. 5C. At each row of stitch formation two stitches are formed on each side of in-lay warp yarn 146. Since the tying yarns 150, 150' are independent from one another; if one tying yarn is broken the remaining tying yarn continues to prevent undue levels of yarn separation.

As with the previously described two bar construction, it is contemplated that the actual yarn selection in the three bar construction may also be subject to a wide range of alternatives. By way of example only, it is contemplated that the weft yarns 144 and in-lay warp yarns 146 may be characterized by a linear density in the range of about 1.9 denier (2 dtex) to about 1500 denier (1670 dtex). Such yarns may be monofilament or multifilament with flat, textured or spun construction. The tying yarns 150, 150' are preferably characterized by a linear density in the range of about 5.5 denier (6 dtex) to about 250 denier (280 dtex). Each of the yarns may be formed of suitable fiber materials such as polyester, nylon, polyurethane, aramid, polyethylene, NOMEX® or the like. It is also contemplated that combinations of any such yarns and materials may be utilized if desired.

Of course, it is contemplated that the actual stitching arrangement is adaptable to numerous variations that nonetheless cause the tying yarns 150, 150' to each form two stitches at each stitch formation row. The tying yarns 150, 150' may also be knitted in an open stitch arrangement if desired. It is also contemplated that the in-lay warp yarns 146 may be moved in a pattern between adjacent needles in a zigzag orientation such as by using a stitch notation of (0.0/1.1) or (1.1/0.0). It is also contemplated that one, two or three bars can be only partially threaded if desired such that yarns are taken out of the construction and a more open fabric is produced. In this regard it is contemplated that all or a portion of the warp yarns 46 and/or all or a portion of the weft yarns 44 may be eliminated if desired such that a more open knit structure is realized.

As will be understood, even the fully threaded weft inserted warp knit fabrics described herein are of a relatively loose construction compared to traditional woven fabrics. By way of example, a weft inserted warp knit as illustrated and described in relation to FIG. 7 and including a permeability blocking covering has a mass per unit area that is about 35% less than a woven fabric formed from yarns with comparable linear densities. This reduction in weight corresponds to a substantially reduced requirement for fibrous yarns.

In a number of environments such as airbags, awnings, grass catcher bags and the like, it may be desirable to close off permeability across the fabric. In such environments a permeability blocking coating may be applied across at least one side of the weft inserted warp knit fabric. By the term "coating" is meant one or more layers of any applied covering material. By way of example only, and not limitation, such coatings may include laminated films, transfer coatings, extrusion coatings and the like. High strength polymeric films may be particularly preferred. By way of example only, and not limitation, various contemplated film materials may include acrylates, polyolefins, polyethers, polyesters, polycarbonates or polyurethanes and polyurethanes. By way of example only, such films may be applied to a side of the weft inserted warp knit fabric by techniques such as hot film lamination using an intermediate adhesive precoat, as well as by transfer coating or extrusion coating.

Figure 6:
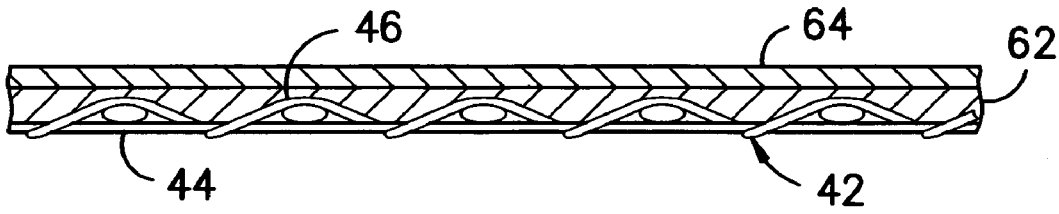
FIG. 6 is a view of a first embodiment of a weft inserted warp knit substrate with an applied permeability blocking covering looking in the warp direction along line 6—6 in FIG. 2.

One embodiment of the resultant material following film lamination is illustrated in FIG. 6 wherein a weft inserted warp knit substrate 42 as previously described in relation to FIG. 2 is coated across one side with an adhesive precoat 62 and a film covering 64. Of course, the covering layers may also be applied across the other side of the substrate 42 or on both sides if desired. Likewise, suitable coatings may also be applied across one or both sides of a substrate 142 having multiple cooperative tying yarns as described in relation to FIG. 5.

Figure 7:
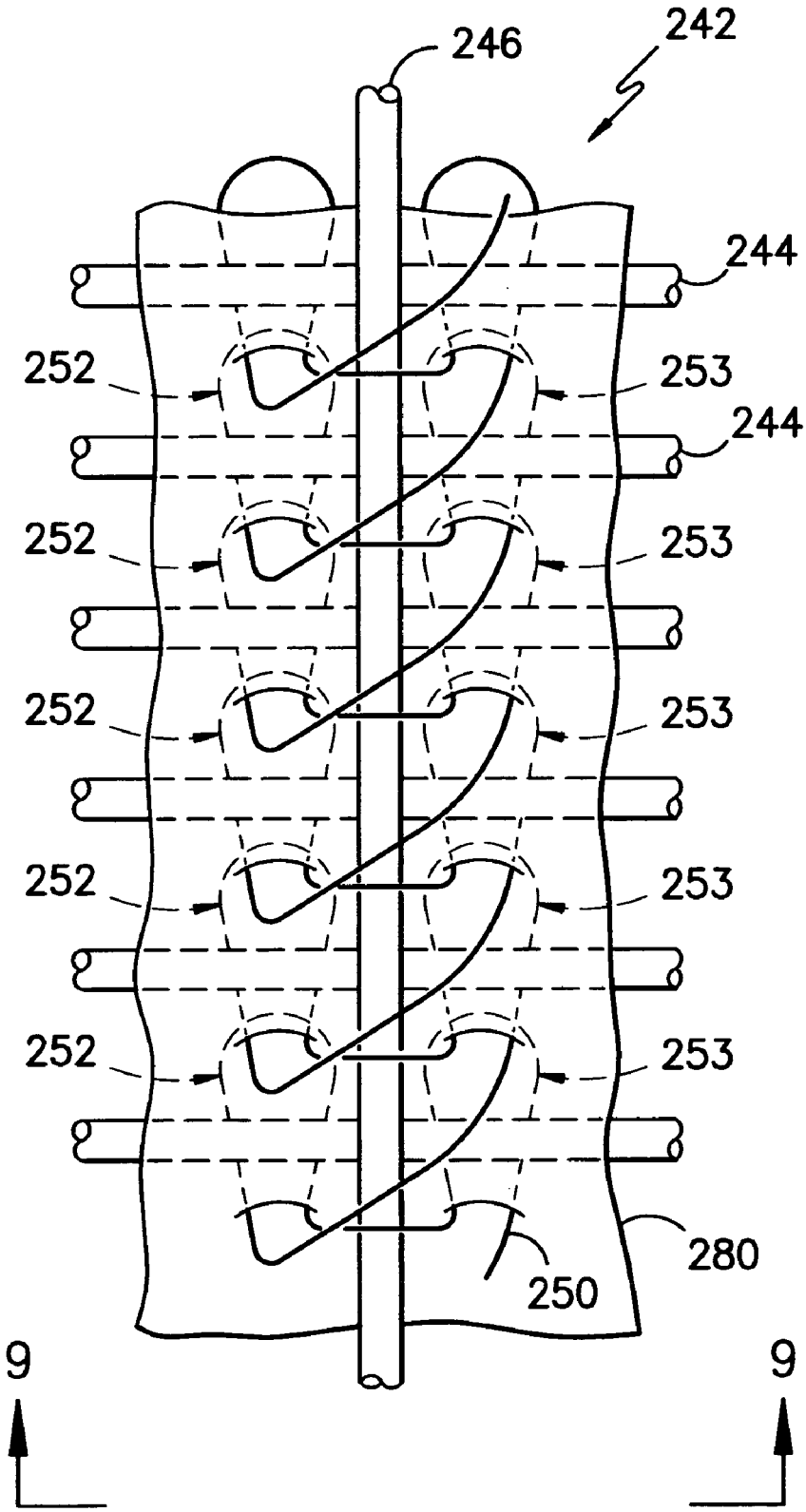
FIG. 7 is a view similar to FIG. 2, illustrating a two bar weft inserted warp knit construction for an air bag fabric with a tying yarn forming pairs of stitches on either side of an inlay warp yarn at every row of stitch formation and with stitches formed through a ground layer of fiber or film material disposed between the warp yarns and the weft yarns.

It is also contemplated that any of the weft inserted warp knit substrate constructions as previously described may further incorporate a fibrous or film ground layer through which the tying yarn is stitched. By way of example only, and not limitation, FIG. 7 illustrates a construction similar to FIG. 2 incorporating such a ground layer 280 disposed between the warp yarns 246 and the weft yarns 244 and wherein elements corresponding to those previously described are designated by corresponding reference numerals within a 200 series. The ground layer 280 may be any suitable material including a polymeric film, fibrous textile or the like. A nonwoven batting material of polyester or the like may be particularly desirable. As will be appreciated, the ground layer 280 may provide a degree of anchoring support and stability for the tying yarn 250. The ground layer may also aid in establishing a base for an effective permeability blocking coating. Of course, it is also contemplated that the ground layer 280 may be positioned on one side or the other of the construction formed by the warp yarns and the weft yarns rather than being located between the yarns.

Figure 8:
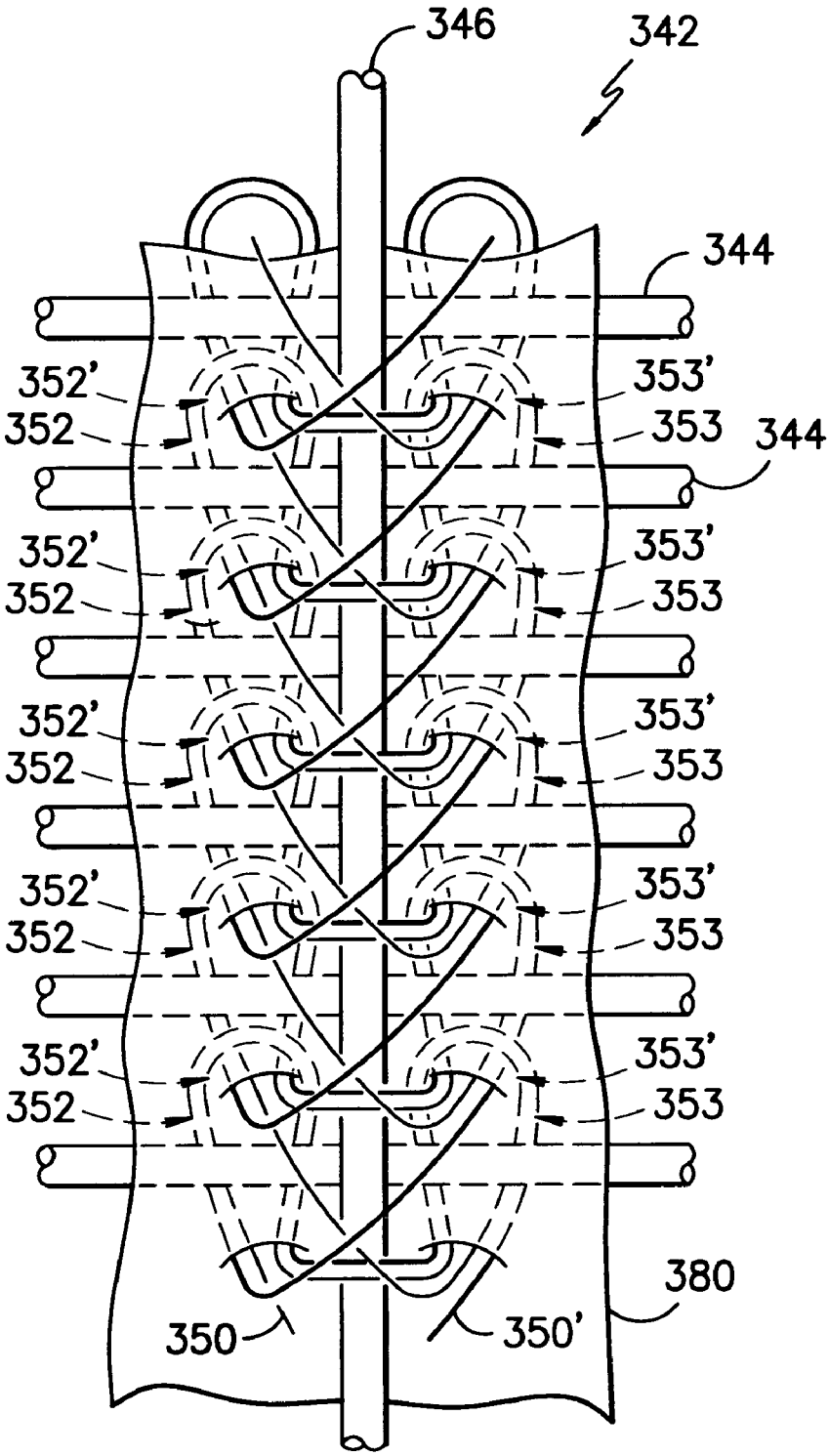
FIG. 8 is a view similar to FIG. 5, illustrating a three bar weft inserted warp knit construction for a fabric with two tying yarns each forming pairs of stitches on either side of an inlay warp yarn at every row of stitch formation and with stitches formed through a ground layer of fiber or film material disposed between the warp yarns and the weft yarns.

FIG. 8 illustrates a construction similar to FIG. 5 incorporating a ground layer 380 disposed between the warp yarns 346 and the weft yarns 344 and wherein elements corresponding to those previously described are designated by corresponding reference numerals within a 300 series. The ground layer 380 may be any suitable material including a polymeric film, fibrous textile or the like. A nonwoven batting material of polyester or the like may be particularly desirable. Of course, it is also contemplated that the ground layer 380 may be positioned on one side or the other of the construction formed by the warp yarns and the weft yarns rather than being located between the yarns.

Figure 9:
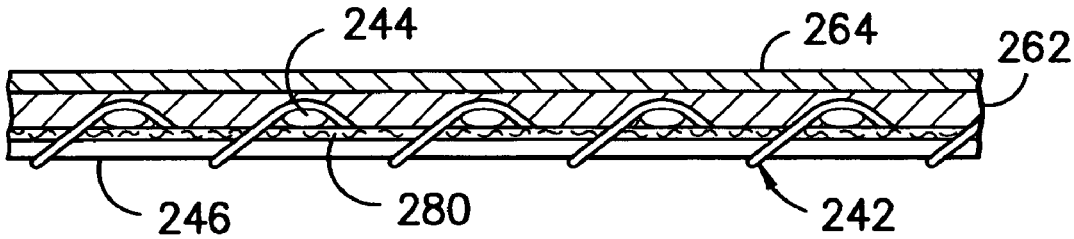
FIG. 9 is a view of an embodiment of a weft inserted warp knit substrate with an applied permeability blocking covering looking in the warp direction along line 9—9 in FIG. 7.

One embodiment of a resultant fabric material incorporating a fibrous or film ground layer is illustrated in FIG. 9 wherein a weft inserted warp knit substrate 242 as previously described in relation to FIG. 7 is coated across one side with an adhesive precoat 262 and a film covering 264. Of course, the covering layers may also be applied across the other side of the substrate 242 or on both sides if desired. Likewise, suitable coatings may also be applied across one or both sides of a substrate 342 having multiple cooperative tying yarns as described in relation to FIG. 8.

As indicated previously, the construction of the fabric material incorporating pairs of stitches at each row provides substantial resistance to seam combing thereby enhancing effective seam strength. In order to demonstrate combing resistance provided by fabric constructions formed according to the present invention, specimens of the two bar and three bar constructions as described in relation to FIGS. 2 and 5 respectively were subjected to edgecomb resistance testing using the procedures outlined in the current version of ASTM test method D6479 the contents of which are incorporated herein in their entirety. As will be appreciated by those of skill in the art, the measurement of a fabric's edgecomb resistance indicates the relative tendency of the fabric to pull apart under seam stress or similar action. The test is carried out by clamping one end of a test specimen within the jaw of a tensile testing machine. A special fixture pierces a row of equally spaced needle holes through opposite ends of the specimen. A tensile force is applied until rupture occurs. The measurement of the force required for rupture is the measurement of edgecomb resistance.

Figure 10:
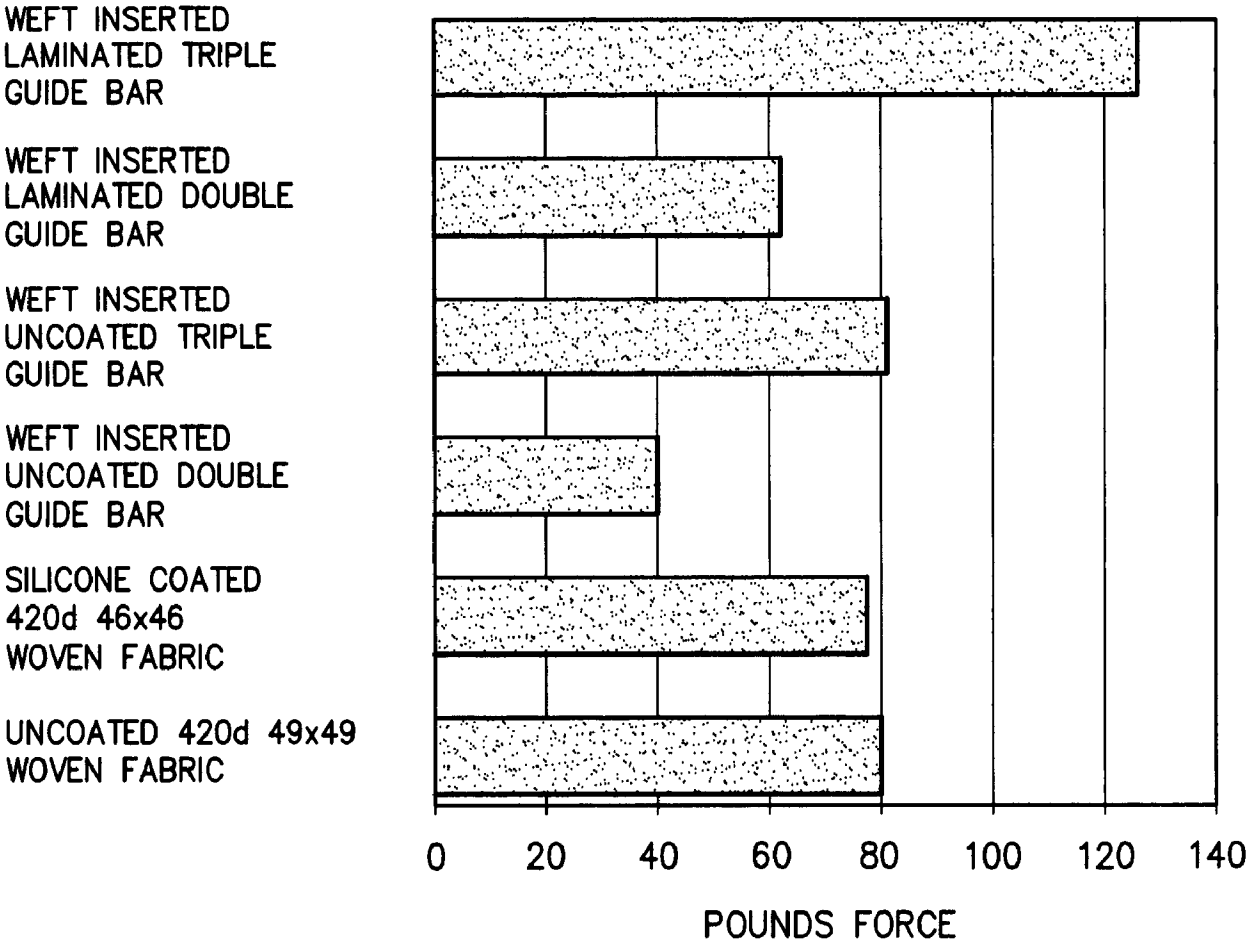
FIG. 10 is bar graph illustrating relative edgecomb resistance performance of various embodiments of the present invention and prior fabrics.

Edgecomb resistance tests were carried out on both the two guide bar weft inserted warp knit construction illustrated and described in relation to FIG. 2 and on the three guide bar weft inserted warp knit construction illustrated and described in relation to FIG. 5. These constructions were tested in both a laminated state and in an uncoated state. The two guide bar and three guide bar weft inserted warp knit constructions tested each utilized 500 denier polyester warp yarns and 500 denier polyester weft yarns with 80 denier polyester tying yarns. The finished yarn density for both the two bar and three bar constructions was 18 warp yarns per inch×17 weft yarns per inch. The laminated constructions utilized a polycarbonate polyurethane film held in place with an adhesive precoat. However, other suitable covering constructions can also be utilized. In the laminated constructions the total mass per unit area of the film and precoat was 0.9 ounces per square yard. Comparative edgecomb tests were also conducted on a silicone coated woven fabric with the same coating weight formed from 420 denier nylon yarn at a weave density of 46 warp yarns per inch×46 weft yarns per inch as well as on an uncoated woven fabric formed from 420 denier nylon yarn at a weave density of 49 warp yarns per inch×49 weft yarns per inch. The results of this comparative testing are presented graphically at FIG. 10 showing that embodiments of the present invention provide substantially equivalent or better results than traditional woven fabrics. In particular, even in the non-laminated (i.e. uncoated) state, both the double and triple guide bar constructions exhibited edgecomb resistance levels of about 40 pounds force or greater. Such results are achieved despite the fact that the weight of fiber used is reduced by about 35% relative to equivalently performing woven fabrics.

A comparative edgecomb test was also conducted on an uncoated traditional weft inserted warp knit fabric incorporating 500 denier polyester warp yarns and 500 denier polyester weft yarns with 80 denier polyester tying yarns with 18 warp yarns per inch×17 weft yarns per inch. Unlike the inventive constructions, the comparative sample had only one stitch formed at each row. The measured edgecomb resistance for the traditional weft inserted warp knit fabric was under 30 pounds thereby indicating substantially better performance by the construction of the present invention.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the following claims and all equivalents thereto.

What is claimed is:

1. A welt inserted warp knit fabric construction, wherein the fabric comprises a plurality of warp yarns disposed in a first plane and a plurality of weft yarns disposed in a second plane adjacent the first plane, wherein the warp yams and the welt yams are tied together by warp knitted stitching yarns, and wherein at least a portion of the stitching yarns form a double column pattern of stitches disposed on opposite sides of individual warp yarns at rows of stitch formation along the length of the warp yarns with stitches on the opposite sides of the warn yarns being formed by interlocking loops of the same yarn and adjacent rows of stitch formation along the length of an individual warp yarn are formed from the same stitching yarn.

2. A vehicle airbag comprising the fabric construction of claim 1.

* * * * *

UNITED STATES PATENT AND TRADEMARK OFFICE

CERTIFICATE OF CORRECTION

PATENT NO. : 7,174,749 B2
APPLICATION NO. : 11/321470
DATED : February 13, 2007
INVENTOR(S) : Ternon et al.

It is certified that error appears in the above-identified patent and that said Letters Patent is hereby corrected as shown below:

Column 8, Claim 1, Line 50 “welt” should be --weft--

Column 8, Claim 1, Line 54 “welt yams” should be --weft yarns--

Column 8, Claim 1, Line 59 “warn” should be --warp--

Signed and Sealed this

Seventeenth Day of April, 2007

JON W. DUDAS
*Director of the United States Patent and Trademark Office*